US008562762B2

(12) United States Patent
Yokoi et al.

(10) Patent No.: US 8,562,762 B2
(45) Date of Patent: Oct. 22, 2013

(54) HIGH STRENGTH HOT ROLLED STEEL PRODUCTS FOR LINE-PIPES EXCELLENT IN LOW TEMPERATURE TOUGHNESS AND PRODUCTION METHOD OF THE SAME

(75) Inventors: Tatsuo Yokoi, Tokyo (JP); Masanori Minagawa, Tokyo (JP); Takuya Hara, Tokyo (JP); Osamu Yoshida, Tokyo (JP); Hiroshi Abe, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 121 days.

(21) Appl. No.: 12/449,815

(22) PCT Filed: Feb. 29, 2008

(86) PCT No.: PCT/JP2008/054104

§ 371 (c)(1),
(2), (4) Date: Aug. 26, 2009

(87) PCT Pub. No.: WO2008/132882

PCT Pub. Date: Nov. 6, 2008

(65) Prior Publication Data

US 2010/0084054 A1 Apr. 8, 2010

(30) Foreign Application Priority Data

Mar. 1, 2007 (JP) ..... 2007-052040

(51) Int. Cl.

| | |
|---|---|
| ***C22C 38/00*** | (2006.01) |
| ***C22C 38/04*** | (2006.01) |
| ***C22C 38/14*** | (2006.01) |
| ***C21D 11/00*** | (2006.01) |
| ***C21D 8/00*** | (2006.01) |

(52) U.S. Cl.

USPC ..... 148/337; 148/504; 148/648; 420/120; 420/126; 420/128

(58) Field of Classification Search

USPC ..... 148/320, 330–333, 336, 337, 504, 579, 148/593, 602, 648; 420/83, 89, 104, 420/119–121, 126–128

See application file for complete search history.

(56) References Cited

U.S. PATENT DOCUMENTS

| | | | |
|---|---|---|---|
| 2009/0925151 | | 4/2009 | Nakashima et al. |
| 2010/0000633 | A1 | 1/2010 | Yokoi et al. |

FOREIGN PATENT DOCUMENTS

| | | | |
|---|---|---|---|
| CA | 2591878 | A1 * | 7/2006 |
| EP | 2 006 407 | | 12/2008 |
| JP | 7-173536 | | 7/1995 |
| JP | H08-85841 | | 4/1996 |
| JP | 11-302776 | | 11/1999 |
| JP | 2005-503483 | | 2/2005 |
| JP | 3846729 | | 2/2005 |
| JP | 2005-240051 | | 9/2005 |
| JP | 2005-264217 | | 9/2005 |
| JP | 2006-274338 | | 10/2006 |
| WO | WO 03/025241 | | 3/2003 |
| WO | WO 2006/077760 | | 7/2006 |
| WO | WO 2008/078917 | | 7/2008 |

OTHER PUBLICATIONS

Kobayashi et al., English machine translation of JP 2006-274338, Oct. 12, 2006, whole document.*

Bramfitt et al., Metallography and Microstructures of Carbon and Low-Alloy Steels—ASM Handbook, 2004, ASM International, vol. 9, p. 1-33.*

European Search Report in corresponding application No. EP 08 79 0547 dated May 4, 2010.

International Search Report dated May 13, 2008 issued in corresponding PCT Application No. PCT/JP2008/054104.

Asahi et al., "Development of Ultra-high-strength Linepipe, X120", (2004), Nippon Steel Technical Report, No. 90, pp. 82-87 and 70-75.

* cited by examiner

*Primary Examiner* — Roy King
*Assistant Examiner* — Caitlin Kiechle
(74) *Attorney, Agent, or Firm* — Kenyon & Kenyon LLP

(57) ABSTRACT

The present invention provides high strength hot rolled steel plate for line-pipes superior in low temperature toughness, and a method of production of the same, containing, by mass %, C: 0.01 to 0.1%, Si: 0.05 to 0.5%, Mn: 1 to 2%, P: ≤0.03%, S: ≤0.005%, O: ≤0.003%, Al: 0.005 to 0.05%, N: 0.0015 to 0.006%, Nb: 0.005 to 0.08%, and Ti: 0.005 to 0.02%, where $N-14/48\times Ti>0\%$ and $Nb-93/14\times(N-14/48\times Ti)>0.005\%$, and a balance of Fe and unavoidable impurities, said steel plate characterized in that its microstructure is a continuously cooled transformed structure, a reflected X-ray intensity ratio {211}/{111} of the {211} plane and {111} plane parallel to the plate surface in the texture at the center of plate thickness is 1.1 or more, and an in-grain precipitate density of the precipitates of Nb and/or Ti carbonitrides is $10^{17}$ to $10^{18}/cm^3$.

7 Claims, 3 Drawing Sheets

HIGH STRENGTH HOT ROLLED STEEL PRODUCTS FOR LINE-PIPES EXCELLENT IN LOW TEMPERATURE TOUGHNESS AND PRODUCTION METHOD OF THE SAME

This application is a national stage application of International Application No. PCT/JP2008/054104, filed 29 Feb. 2008, which claims priority to Japanese Application No. 2007-052040, filed 1 Mar. 2007, which is incorporated by reference in its entirety.

TECHNICAL FIELD

The present invention relates to high strength hot rolled steel products like plates or sheets for line-pipes using as a material hot coil excellent in low temperature toughness and a method of production of the same.

BACKGROUND ART

In recent years, regions for development of crude oil, natural gas, and other energy resources have been shifting to the North Sea, Siberia, Northern America, Sakhalin, and other frigid areas and further to the North Sea, Gulf of Mexico, Black Sea, Mediterranean, Indian Ocean, and other deep seas, that is, regions of harsh natural environments. Further, from the viewpoint of the emphasis on prevention of global warming, there has been an increase in development of natural gas. At the same time, from the economical viewpoint of pipeline systems, reduction of the weight of the steel materials and increase in the operating pressure has been sought. The properties sought from line-pipes have become increasingly sophisticated and diverse in accordance with these changes in environmental conditions. They may be roughly classified into demands for (1) greater wall thickness/higher strength, (2) higher toughness, (3) reduction of the carbon equivalent (Ceq) accompanying improvement of on-site weldability (circumferential direction weldability), (4) increased corrosion resistance, and (5) high deformation performance in frozen ground and earthquake/fault line belts. Further, these properties are usually demanded in combination along with the usage environments.

Furthermore, with the backdrop of the recent increase in crude oil and natural gas demand, far off locations and regions of tough natural environments which have been passed over for development due to their unprofitability are starting to be exploited in earnest. In particular, the line-pipes used for pipelines transporting crude oil and natural gas over long distances are being strongly required to be increased in thickness and strength for improving the transport efficiency and also to be increased in toughness so as to be able to withstand use in frigid areas. Achievement of both of these demanded properties is becoming a pressing technical issue.

On the other hand, steel pipe for line-pipes can be classified by its process of production into seamless steel pipe, UOE steel pipe, seam welded steel pipe, and spiral steel pipe. These are selected according to the application, size, etc., but with the exception of seamless steel pipe, each by nature is made by shaping steel plate or steel strip into a tubular form, then welding the seam to obtain a steel pipe product.

Furthermore, these welded steel pipes can be classified according to if they use hot coil or use plate for the materials. The former are seam welded steel pipe and spiral steel pipe, while the latter are UOE steel pipe. For high strength, large diameter, thick wall applications, the latter UOE steel pipe is generally used, but for cost and speed of delivery, the former seam welded steel pipe and spiral steel pipe made using hot coil as a material are being required to be made higher in strength, larger in diameter, and thicker in walls:

In UOE steel pipe, technology for production of high strength steel pipe corresponding to the X120 grade has been disclosed (for example, see "Nippon Steel Monthly", No. 380, 2004, page 70).

However, the above art is predicated on use of thick-gauge plate as a material. To achieve both higher strength and greater wall thickness, a feature of the thick-gauge plate production process, that is, interrupted direct quench (IDQ), is used at a high cooling rate and low cooling stop temperature. In particular, to secure strength, quench strengthening (texture strengthening) is being used.

As opposed to this, with the hot coil material of seam welded steel pipe and spiral steel pipe covered by the present invention, there is the feature of the coiling process. Due to restrictions in the capacity of coilers, it is difficult to coil a thick-gauge material at a low temperature, so it is impossible to stop the cooling at the low temperature required for quench strengthening. Therefore, securing strength by quench strengthening is difficult.

On the other hand, as technology for achieving both the higher strength and greater wall thickness and the low temperature toughness of hot coil for line-pipes, the technology has been disclosed of adding Ca—Si at the time of refining to make the inclusions spherical, adding V with the crystal refinement effect in addition to the strengthening elements of Nb, Ti, Mo, and Ni, and, furthermore, making the microstructure bainitic ferrite or acicular ferrite to secure the strength by combining low temperature rolling and low temperature cooling (for example, see Japanese Patent No. 3846729 (Japanese Patent Publication (A) No. 2005-503483)).

However, to avoid crack starting points occurring due to brittle fracture from ending up propagating endlessly due to unstable ductile fracture, sought not in petroleum but particularly gas line-pipes, it is necessary to increase the absorption energy at the pipe line usage temperature, but the above art not only does not allude to the art of suppressing the drop in absorption energy due to the occurrence of separation (art of improvement of unstable ductile fracture resistance), but also requires the addition of a certain amount or more of the extremely expensive alloy element V among the alloy elements. This not only invites an increase in cost, but also is liable to reduce the on-site weldability.

Further, from the viewpoint of lowering the transition temperature, art taking note of separation and actively utilizing it is disclosed (for example, see Japanese Patent Publication (A) No. 8-85841). However, the increase in separation improves the low temperature toughness, but on the other hand ends up reducing the absorption energy, so there is the problem that the unstable ductile fracture resistance is caused to deteriorate.

DISCLOSURE OF THE INVENTION

Therefore, the present invention has as its object the provision of hot rolled steel products like steel plates or steel sheets for line-pipes having low temperature toughness sufficient to withstand use in frigid regions needless to say and able to withstand use even in regions where the tough unstable ductile fracture resistance is demanded, sought from gas line-pipes, and further having a high strength of the API-X70 standard or higher with a plate thickness of for example 14 mm or more yet superior in absorption energy at the pipe usage temperature, and a method able to inexpensively produce that steel plate. Specifically, it has as its object the provision of steel plate meeting the API-X70 standard after formation into pipe by anticipating sufficient bias and giving a strength of the steel plate before pipe making of 620 MPa or more and an upper shelf energy of a DWTT test, an indicator of the unstable ductile fracture resistance, of 10000 J or more and SATT (85%) of −20° C. or less, and a method able to inexpensively produce that steel plate.

The present invention solves the above problem by using an ultra thick gauge hot coil material, but making its microstructure not ferrite-pearlite, but a continuously cooled transformed structure advantageous to low temperature toughness and unstable fracture resistance. The means are as follows:

(1) High strength hot rolled steel products for line-pipes superior in low temperature toughness containing, by mass %, C: 0.01 to 0.1%,
Si: 0.05 to 0.5%,
Mn: 1 to 2%,
P: ≤0.03%,
S: ≤0.005%
O: ≤0.003%,
Al: 0.005 to 0.05%,
N: 0.0015 to 0.006%,
Nb: 0.005 to 0.08%, and
Ti: 0.005 to 0.02%, where
N−14/48×Ti>0% and
Nb−93/14×(N−14/48×Ti)>0.005%, and
a balance of Fe and unavoidable impurities,
said steel products like steel plates characterized in that its microstructure is a continuously cooled transformed structure, a reflected X-ray intensity ratio {211}/{111} of the {211} plane and {111} plane parallel to the plate surface in the texture at the center of plate thickness is 1.1 or more, and an in-grain precipitate density of the precipitates of Nb and/or Ti carbonitrides is $10^{17}$ to $10^{18}$/$cm^3$.

(2) High strength hot rolled steel products for line-pipes superior in low temperature toughness as set forth in the above (1), characterized by further containing, in addition to the above composition, by mass %, one or more of V: 0.01 to 0.3%,
Mo: 0.01 to 0.3%,
Cr: 0.01 to 0.3%,
Cu: 0.01 to 0.3%,
Ni: 0.01 to 0.3%,
B: 0.0002 to 0.003%,
Ca: 0.0005 to 0.005%, and
REM: 0.0005 to 0.02%.

(3) A method of production of high strength hot rolled steel products for line-pipes superior in low temperature toughness comprising heating a steel slab containing ingredients described in the above (1) or (2) to a temperature satisfying the following formula:

$$SRT(°\ C.)=6670/(2.26-\log[\%\ Nb][\%\ C])-273$$

to 1230° C., further holding it at that temperature region for 20 minutes or more, then hot rolling to a total reduction rate of a pre-recrystallization temperature region of 65% or more, ending that rolling at an $Ar_3$ transformation point temperature or more, then starting cooling within 5 seconds, cooling in the temperature region from the start of cooling to 700° C. by 15° C./sec or more of a cooling rate, and coiling at 450° C. to 650° C.

(4) A method of production of high strength hot rolled steel products for line-pipes superior in low temperature toughness as set forth in the above (3) characterized by cooling before rolling in the said pre-recrystallization temperature region.

BEST MODE FOR CARRYING OUT THE INVENTION

The inventors etc. first ran experiments as follows envisioning the case of the API-X70 standard as an example for investigating the relationship between the tensile strength and toughness of hot rolled steel plate (in particular the occurrence of separation and the drop in absorption energy due to the same) and the microstructure etc. of steel plate.

Cast slabs of the steel ingredients shown in Table 1 were produced and rolled under various hot rolling conditions to make 17 mm thick test steel plates. These were investigated for results of DWTT tests and for separation indexes and reflected X-ray plane intensity ratios. The methods of investigation are shown below.

The DWTT (Drop Weight Tear Test) test was performed by cutting out a strip shaped test piece of 300 mmL×75 mmW× plate thickness (t) mm from the C direction and making a 5 mm press notch in it to prepare a test piece. After the test, the degree of separation occurring at the fracture surface was converted to a numerical value by measurement of the separation index (below, "S.I.") The S.I. was defined as the total length of separation parallel to the plate surface (Σni×li, where l is the separation length) divided by the sectional area (plate thickness×(75-notch depth)).

The reflected X-ray plane intensity ratio (below, the "plane intensity ratio") is the ratio of intensity of the {211} plane to the intensity of the {111} plane parallel to the plate surface at the center of plate thickness, that is, {211}/{111}, and is the value measured using X-rays by the method shown in the ASTM Standards Designation 81-63. For the measurement apparatus of this test, a Rigaku Model RINT1500 X-ray measurement apparatus was used. The measurement was performed at a measurement speed of 40/min. As the X-ray source, Mo—Kα was used under conditions of a tube voltage of 60 kV and tube current of 200 mA, while as a filter, Zr—Kβ was used. For the goniometer, a wide angle goniometer was used. The step width was 0.010°, while the slits included a dispersion slit of 1°, a scattering slit of 1°, and a receiving slit of 0.15 mm.

In general, the occurrence of separation lowers the transition temperature and is considered preferable for the low temperature toughness, but when the unstable ductile fracture resistance becomes an issue like with a gas line-pipes, to improve this, the upper shelf energy has to be improved. For this reason, it is necessary to suppress the occurrence of separation.

Figure 1:
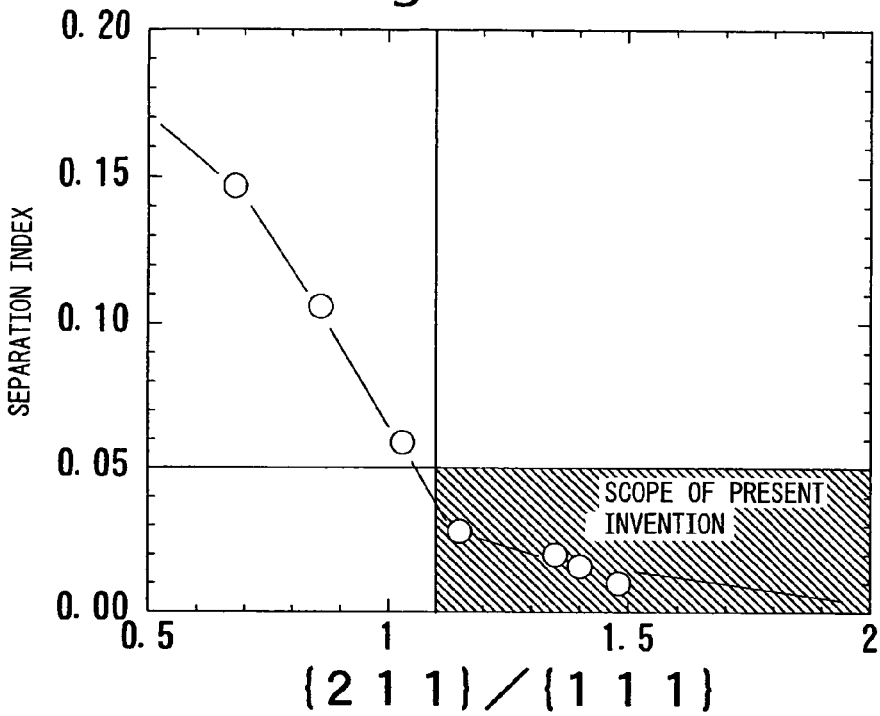
FIG. 1 is a view of the relationship between the plane intensity ratio and the S.I.

The relationship between the plane intensity ratio and S.I. in hot rolled steel plate is shown in FIG. 1. If the plane intensity ratio is 1.1 or more, the S.I. stabilizes at a low level and becomes a value of 0.05 or less. If controlling the plane intensity ratio to 1.1 or more, it was learned that the separation can be suppressed to a level not a problem in practice. More preferably, by controlling the plane intensity ratio to 1.2 or more, the S.I. can be made 0.02 or less.

Further, by suppressing the separation, a clear tendency for improvement of the upper shelf energy in a DWTT test is also confirmed. That is, if {211}/{111} becomes 1.1 or more, the occurrence of separation is suppressed, the S.I. stabilizes at a low level of 0.05 or less, the drop in the indicator of the unstable ductile fracture resistance, the upper shelf energy, due to the occurrence of separation is suppressed, and an energy of 10000 J or more is obtained.

Separation is believed to be due to the plastic anisotropy of {111} and {100} crystallographic colonies distributed in bands and to occur at the boundary surfaces of such adjoining colonies. Among these crystallographic colonies, it has become clear that {111} particularly develops by α (ferrite)+γ (austenite) dual-phase rolling at less than the $Ar_3$ transformation point temperature. On the other hand, if rolling at a pre-recrystallization temperature of the γ region of the $Ar_3$ transformation point temperature or more, the representative rolled texture of FCC metal, that is, a Cu-type texture, is strongly formed. It is known that even after γ→α transformation, a texture with highly developed {111} is formed. By suppressing the formation of such texture, it is possible to avoid the occurrence of separation.

Next, the inventors investigated the above test hot rolled steel plates for tensile strength and DWTT test results, the steel plate microstructure, the in-grain precipitate density of the Nb and/or Ti carbonitride precipitate, etc. The method of investigation is shown below.

The tensile test was conducted by cutting out a No. 5 test piece described in JIS Z 2201 from the C direction and following the method of JIS Z 2241.

Next, for measurement of the precipitate density of Nb and/or Ti carbonitride precipitates precipitated not at the grain boundaries, but in the microstructure, the "in-grain precipitate density of the Nb and/or Ti carbonitride precipitates" in the present invention is defined as the number of Nb and/or Ti carbonitride precipitates measured by the later explained measurement method divided by the volume of the measured range.

To measure the precipitate density of Nb and/or Ti carbonitride precipitates precipitating in the grains, the 3D atom probe method was used. The measurement conditions were a sample position temperature of about 70K, a probe total voltage of 10 to 15 kV, and a pulse ratio of 25%. The grain boundaries and insides of grains of the samples were measured three times each and the average values were used as representative values.

On the other hand, the microstructure was investigated by cutting out a sample from a position of ¼ W or ¾ W of the steel plate thickness, polishing the sample at the rolling direction cross-section, etching it using a Nital reagent, and taking a photograph of the field at ½t of the plate thickness observed using an optical microscope at a magnification of 200 to 500×. The "volume fraction of the microstructure" is defined as the area fraction in the above metal structure photograph. Here, the "continuously cooled transformed structure (Zw)" is, as described in the Iron and Steel Institute of Japan, Basic Research Group, Bainite Survey and Research Group ed., Recent Research Relating to Bainite Structure and Transformation Behavior of Low Carbon Steel—Final Report of Bainite Research Subcommittee—(1994 Iron and Steel Institute of Japan), a microstructure defined as a transformed structure in the intermediate stage of martensite formed without dispersion by a shear mechanism with a microstructure including polygonal ferrite or pearlite formed by a diffusion mechanism. That is, the "continuously cooled transformed structure (Zw)" is defined as a microstructure observed by an optical microscope, as described in the above Reference Document, page 125 to 127, mainly comprised of bainitic ferrite (α° B), granular bainitic ferrite (αB), and quasi-polygonal ferrite (αq) and furthermore containing small amounts of residual austenite (γr) and martensite-austenite (MA). "αq", like polygonal ferrite (PF), is not revealed in internal structure due to etching, but has an acicular shape and is clearly differentiated from PF. Here, if the circumferential length of the crystal grains covered is lq and the circular equivalent diameter is dq, grains with a ratio of these (lq/dq) satisfying lq/dq≥3.5 are αq. The continuously cooled transformed structure (Zw) in the present invention is defined as a microstructure including one or more of α° B, αB, αq, γr, and MA among these. However, the total of the small amounts of γr and MA is made 3% or less.

Figure 2:
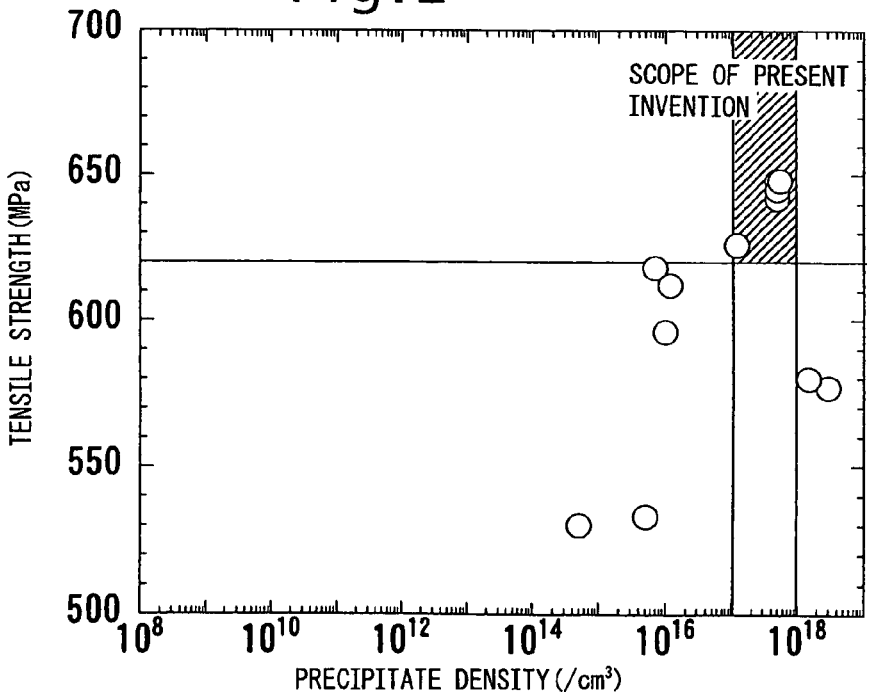
FIG. 2 is a view of the relationship between the tensile strength and the precipitation density of Nb and/or Ti carbonitride precipitates precipitating in the grains.

FIG. 2 shows the relationship between the tensile strength of the hot rolled steel plate and the precipitate density of the Nb and/or Ti carbonitride precipitates precipitating in the grains. The precipitate density of the Nb and/or Ti carbonitride precipitates precipitating in the grains and the tensile strength exhibit an extremely good correlation. If the precipitate density of the Nb and/or Ti carbonitride precipitates precipitating in the grains is $10^{17}$ to $10^{18}/cm^3$, it becomes clear that the effect of precipitation strengthening is obtained most efficiently, the tensile strength is improved, and the tensile strength becomes 620 MPa or more anticipating a sufficient bias for meeting the range of the X70 grade after pipe making.

Regarding the rise of strength due to precipitation strengthening, the Ashby-Orowan relationship is well known. According to this, the amount of rise of strength is expressed as a function of the distance between precipitates and the precipitate particle size. If the precipitate density is over $10^{18}/cm^3$, the tensile strength falls because, it is believed, the precipitate size becomes too small, so dislocation causes the precipitate to end up being cut and the strength not rising due to precipitation strengthening.

Figure 3:
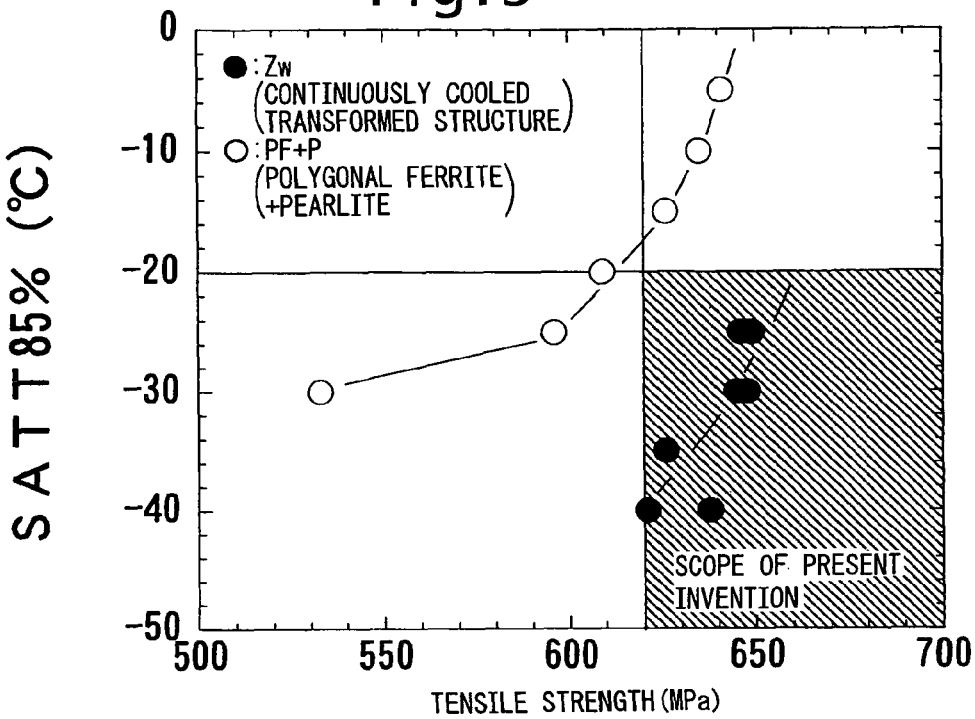
FIG. 3 is a view showing the relationship among the tensile strength, microstructure, and temperature in a DWTT test where the ductile fracture rate becomes 85%.

FIG. 3 shows the relationship between the microstructure and tensile strength of the hot rolled steel plate and the temperature in the DWTT test at which the ductile fracture rate becomes 85%. If the microstructure is the requirement of the present invention of the continuously cooled transformed structure, it becomes clear that compared with a ferrite-pearlite structure, the strength-toughness (temperature in DWTT test at which ductile fracture rate becomes 85%) balance is improved. To make the tensile strength 620 MPa or more anticipating a sufficient bias for meeting the range of the X70 grade after pipe making and making the SATT85% −20° C. or less, a continuously cooled transformed structure is important.

The mechanism by which the strength-toughness balance is improved by the continuously cooled transformed structure is not necessary clear, but the microstructure is mainly comprised of bainitic ferrite (α° B), granular bainitic ferrite (αB), and quasi-polygonal ferrite (αq) and had relatively large slant angle boundaries. A microstructure with fine structural units is believed to have a fine effective crystal grain size, believed to be the main factor affecting cleavage fracture propagation in brittle fracture. It is guessed that this led to the improvement in toughness. Such a microstructure is characterized by a finer effective crystal grain size compared with the general bainite formed by diffusion massive transformation.

As explained above, the inventors clarified the relationship between the microstructure of steel plate and other metallurgical factors and the tensile strength, toughness, and other properties of the hot rolled steel plate, but further studied in detail the relationship of these data with the method of production of steel plate.

Figure 4:
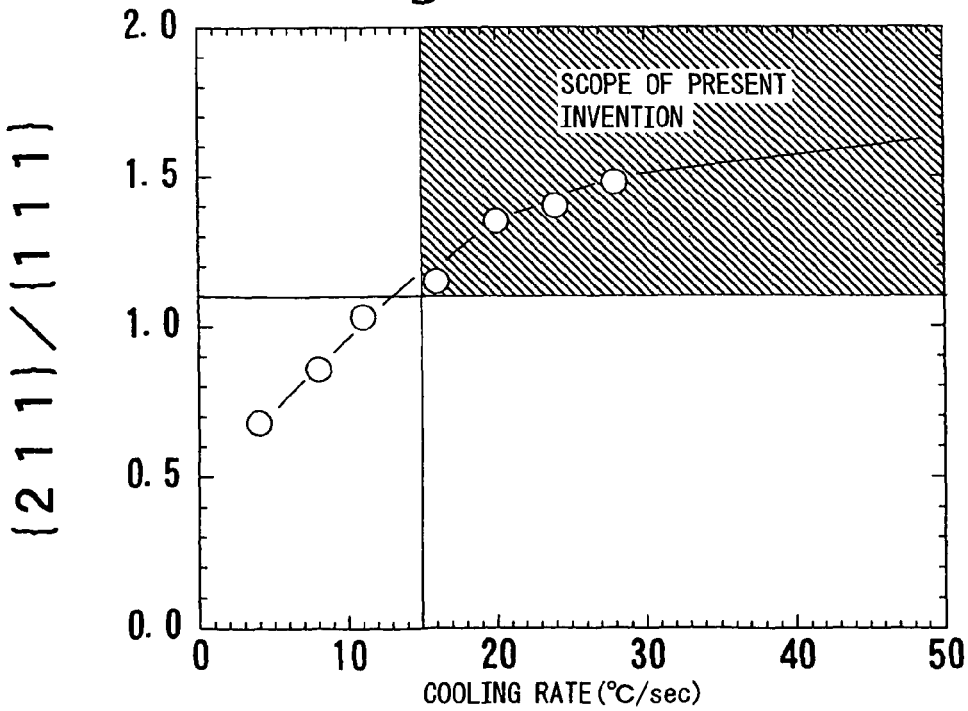
FIG. 4 is a view showing the relationship between the cooling rate in the temperature region from the start of cooling to 700° C. and the plane intensity ratio.

FIG. 4 shows the relationship between the cooling rate and the plane intensity ratio. The cooling rate and the plane intensity ratio are deemed to have an extremely strong correlation. If the cooling rate is 15° C./sec or more, it was learned that the plane intensity ratio becomes 1.1 or more.

That is, the inventors newly discovered that if increasing the cooling rate in the cooling after rolling, the {111} and {100} plane intensities are reduced and the {211} plane intensity increases. Further, they newly discovered that as a result there is a range of planar intensity of {211} to the plane intensity of {111} in which separation can be completely suppressed. The mechanism is not necessarily clear, but if the cooling rate is relatively slow, the $\gamma \rightarrow \alpha$ transformation becomes diffusive, no variant selection occurs, and no {211}//ND orientation accumulation occurs, while if the cooling rate becomes faster, the $\gamma \rightarrow \alpha$ transformation becomes shear like, variant selection proportional to the magnitude of the shear strain of the active slip system occurs, and {211}//ND orientation accumulation occurs. Further, the {211} crystallographic colonies are believed to act to ease the plastic anisotropy of the {111} and {100} crystallographic colonies and to suppress the occurrence of separation.

Figure 5:
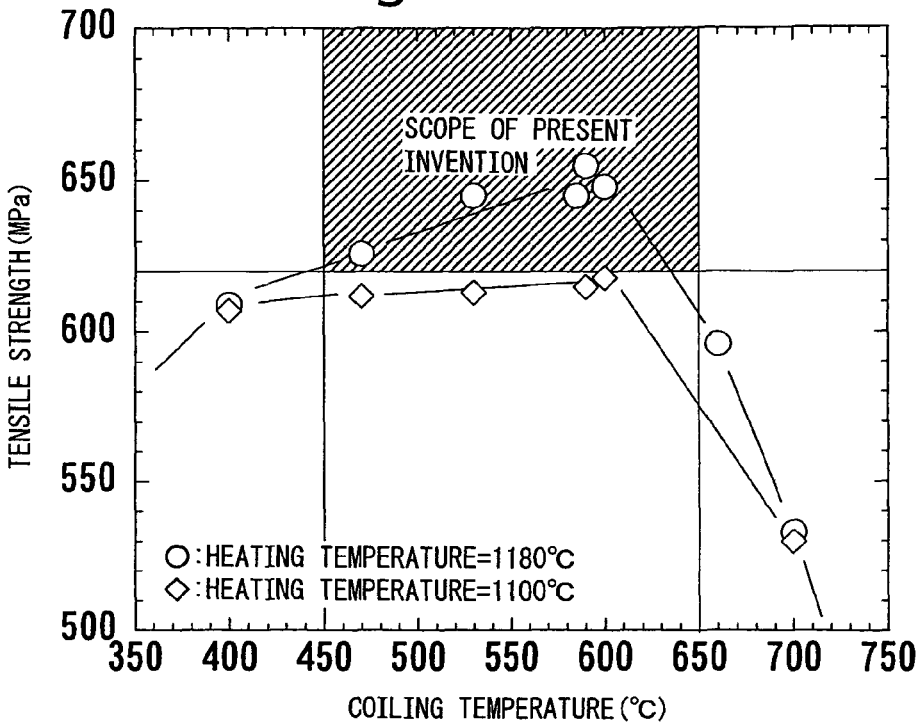
FIG. 5 is a view showing the relationship of the tensile strength, coiling temperature, and heating temperature.

FIG. 5 shows the relationship between the tensile strength and the coiling temperature and heating temperature. The coiling temperature and the tensile strength are deemed to have an extremely strong correlation. If the coiling temperature is 450° C. to 650° C., it was learned that the tensile strength became equivalent to the X70 grade. On the other hand, the inventors investigates the precipitates and as a result the precipitate density of the Nb and/or Ti carbonitride precipitates precipitating in the grains at a coiling temperature of 450° C. to 650° C. was in the scope of the present invention of $10^{17}$ to $10^{18}/cm^3$. Further, even if the coiling temperature is in the scope of the present invention, it is learned that if the heating temperature is less than the solution temperature calculated by the following formula:

$$SRT(^\circ C.)=6670/(2.26-\log[\%\ Nb][\%\ C])-273$$

the precipitate density of the Nb and/or Ti carbonitride precipitates precipitating in the grains will not be in the scope of the present invention of $10^{17}$ to $10^{18}/cm^3$.

In the hot coil material of seam welded steel pipe and spiral steel pipe covered by the present invention, there is a coiling process as a characteristic of the process. Due to the restrictions in the capacity of coilers, it is difficult to coil a thick gauge material at a low temperature. Therefore, to secure the strength, precipitation strengthening is effectively used. For this purpose, to effectively realize precipitation strengthening in the coiling process, it is necessary to dissolve the Nb, Ti, and other precipitation strengthening elements in the slab heating process. Further, to obtain sufficient precipitation strengthening, control to the coiling temperature of the scope of the present invention is necessary. As a result, the precipitate density of the Nb and/or Ti carbonitride precipitates precipitating in the grains becomes the scope of the present invention of $10^{17}$ to $10^{18}/cm^3$ and the strength is sufficiently secured.

Figure 6:
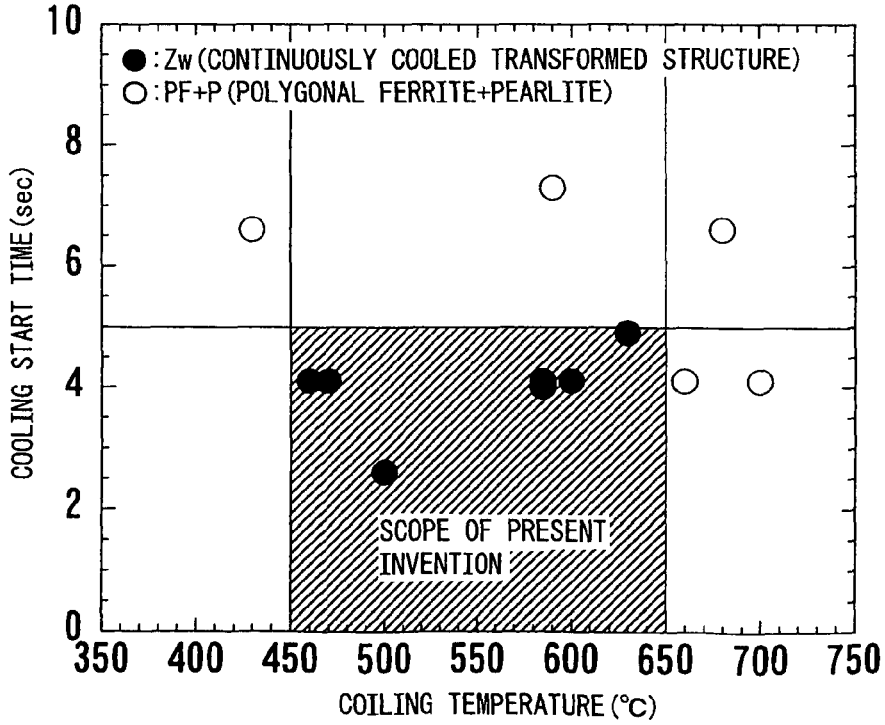
FIG. 6 is a view showing the relationship of the time from the end of rolling to the start of cooling, the coiling temperature, and the microstructure.

Furthermore, FIG. 6 shows the relationship among the time from the end of rolling to the start of cooling, the coiling temperature, and the microstructure. If the time from the end of rolling to the start of cooling is within 5 seconds and the coiling temperature is 450° C. to 650° C., it is learned that the requirement of the present invention of the continuously cooled transformed structure is obtained.

To obtain a superior strength-toughness balance, the microstructure has to be controlled to a continuously cooled transformed structure (Zw). For this purpose, it is necessary to start the cooling in a short time after the end of rolling so as to avoid the formation of initial ferrite. Further, to suppress diffused transformation such as pearlite transformation, it is essential to make the coiling temperature the starting range of the present invention of 450° C. to 650° C.

Next, the reasons for limitation of the chemical ingredients of the present invention will be explained.

C is an element required for obtaining the necessary strength and microstructure. However, if less than 0.01%, the required strength cannot be obtained, while if added over 0.1%, numerous carbides becoming starting points of fracture are formed and the toughness is degraded. Not only that, the on-site weldability is remarkably degraded. Therefore, the amount of addition of C is made 0.01% to 0.1%.

Si has the effect of suppressing the precipitation of carbides becoming starting points of fracture, so 0.05% or more is added, but if adding over 0.5%, the on-site weldability is degraded. Furthermore, if over 0.15%, tiger-stripe scale patterns are formed and the appearance of the surface is liable to be harmed, so preferably the upper limit is made 0.15%.

Mn is a solution strengthening element. Further, it has the effect of expanding the austenite region temperature to the low temperature side and facilitating obtaining the continuously cooled transformed structure of one requirement of the microstructure of the present invention during the cooling after the end of rolling. To obtain these effects, 1% or more is added. However, even if adding Mn in over 2%, the effect is saturated, so the upper limit is made 2%. Further, Mn promotes the center segregation of a continuously cast steel slab and causes the formation of a hard phase becoming a starting point of fracture, so is preferably made 1.8% or less.

P is an impurity. The lower, the better. If included in over 0.03%, it segregates at the center part of the continuously cast steel slab, causes grain boundary fracture, and remarkably reduces the low temperature toughness, so the amount is made 0.03% or less. Furthermore, P has a detrimental effect on the pipe making and on-site weldability, so considering these, 0.015% or less is preferable.

S not only causes cracking at the time of hot rolling, but also, if too great, causes deterioration of the low temperature toughness, so is made 0.005% or less. Furthermore, S segregates near the center of a continuously cast steel slab and forms MnS stretched after rolling and forming starting points of hydrogen induced cracking. Not only this, two-plate cracking and other such pseudo separation are liable to be caused. Therefore, if considering the souring resistance etc., 0.001% or less is preferable.

O forms oxides forming starting points of fracture in steel and causes worse brittle fracture and hydrogen induced cracking, so is made 0.003% or less. Furthermore, from the viewpoint of on-site weldability, 0.002% or less is preferable.

Al has to be added in 0.005% or more for deoxidation of the steel, but invites a rise in cost, so the upper limit is made 0.05%. Further, if added in too large an amount, the nonmetallic inclusions increase and the low temperature toughness is liable to be degraded, so preferably the amount is made 0.03% or less.

Nb is one of the most important elements in the present invention. Nb uses its dragging effect in the solid solute state and/or pinning effect as a carbonitride precipitate to suppress austenite recovery and recrystallization and grain growth during rolling or after rolling, makes the effective crystal grain size finer in crack propagation of a fracture, and improves the low temperature toughness. Furthermore, in the characteristic coiling process in the hot coil production process, fine carbides are formed and their precipitation strengthening contributes to improvement of strength. Furthermore, Nb has the effect of delaying the $\gamma/\alpha$ transformation and lowering the transformation temperature to make the microstructure after transformation the requirement of the present invention of the continuously cooled transformed structure. However, to obtain these effects, addition of at least 0.005% is necessary. Preferably, 0.025% or more is added. On the other hand, even if adding over 0.08%, not only does the effect become saturated, but also causing a solid solute state by a heating process before hot rolling becomes difficult, coarse carbonitrides are formed and become starting points of fracture and the low temperature toughness and souring resistance are liable to be degraded.

Ti is one of the most important elements in the present invention. Ti starts to precipitate as a nitride at a high temperature right after solidification of the iron slab obtained by continuous casting or ingot casting. The precipitates containing these Ti nitrides are stable at a high temperature, do not completely become solid solute even in later slab reheating, exhibit a pinning effect, suppress coarsening of the austenite grains during slab reheating, and make the microstructure finer to improve the low temperature toughness. Further, Ti has the effect of suppressing the formation of nuclei for ferrite in $\gamma/\alpha$ transformation and promoting the formation of the continuously cooled transformed structure of the requirement of the present invention. To obtain such an effect, at least 0.005% of Ti has to be added. On the other hand, even if adding over 0.02%, the effect is saturated. Furthermore, if the amount of addition of Ti becomes the stoichiometric composition with N or more ($N-14/48\times Ti\leq 0\%$), the Ti precipitate formed will become coarser and the above effect will no longer be obtained.

N, as explained above, forms Ti nitrides, has the effect of suppressing coarsening of austenite grains during slab reheating so as to refine the effective crystal grain size in later controlled rolling, and makes the microstructure a continuously cooled transformed structure to thereby improve the low temperature toughness. However, if the content is less than 0.0015%, that effect is not obtained. On the other hand, if contained over 0.006%, along with aging, the ductility falls and the formability at the time of pipe making falls. Furthermore, with $Nb-93/14\times(N-14/48\times Ti)\leq 0.005\%$, the amount of fine Nb carbide precipitate formed in the characteristic coiling process of the hot coil production process is reduced and the strength falls.

Next, the reasons for adding V, Mo, Cr, Ni, and Cu will be explained.

The main reason for further adding these elements to the basic ingredients is to expand the producible plate thickness and improve the strength, toughness, and other characteristics of the base material without detracting from the superior features of the present invention steel. Therefore, the amounts of addition are by nature self limited.

V forms fine carbonitrides in the characteristic coiling process of the hot coil production process and contributes to improvement of strength by precipitation strengthening. However, if added in less than 0.01%, that effect is not obtained and even if added in over 0.3%, the effect is saturated. Further, if added in 0.04% or more, the on-site weldability is liable to be reduced, so less than 0.04% is preferable.

Mo has the effect of improving the hardenability and raising the strength. Further, Mo has the effect of strongly suppressing the recrystallization of austenite at the time of controlled rolling in the copresence with Nb, making the austenite structure finer, and improving the low temperature toughness. However, if added in less than 0.01%, the effect is not obtained, while even if added in over 0.3%, the effect is saturated. Further, if added in 0.1% or more, the ductility is liable to drop and the formability at the time of pipe making to be lowered, so less than 0.1% is preferable.

Cr has the effect of raising the strength. However, even if added in less than 0.01%, that effect is not obtained and even if added in over 0.3%, the effect is saturated. Further, if added in 0.2% or more, the on-site weldability is liable to be reduced, so less than 0.2% is preferable.

Cu has the effect of improvement of the corrosion resistance and hydrogen-induced crack resistance. However, if added in less than 0.01%, that effect is not obtained, while even if added in over 0.3%, the effect is saturated. Further, if added in 0.2% or more, brittle cracks occur at the time of hot rolling and are liable to cause surface defects, so less than 0.2% is preferable.

Ni, compared with Mn or Cr and Mo, forms less hard structures harmful to the low temperature toughness and souring resistance in the rolled structure (in particular center segregation of the slab), therefore has the effect of improvement of the strength without causing deterioration of the low temperature toughness or on-site weldability. If added in less than 0.01%, the effect is not obtained, while even if added in over 0.3%, the effect is saturated. Further, it has the effect of prevention of hot embrittlement by Cu, so is added as a rule in an amount of ⅓ or more of the amount of Cu.

B has the effect of improvement of the hardenability and facilitation of obtaining a continuously cooled transformed structure. Furthermore, B enhances the effect of Mo in improvement of the hardenability and has the effect of increasing the hardenability synergistically in coexistence with Nb. Therefore, it is added in accordance with need. However, if less than 0.0002%, the amount is insufficient for obtaining this effect. If added over 0.003%, slab cracking occurs.

Ca and REM are elements changing the form of nonmetallic inclusions forming starting points of fracture and causing deterioration of the souring resistance so as to render them harmless. However, if added in less than 0.0005%, they have no effect and, with Ca, even if added in over 0.005% and, with REM, in over 0.02%, large amounts of oxides are formed, clusters and coarse inclusions are formed, the low temperature toughness of the welded seams is degraded, and the on-site weldability is also adversely effected.

Note that the steels having these as main ingredients may also contain Zr, Sn, Co, Zn, W, and Mg in a total of 1% or less. However, Sn is liable to cause embrittlement and defects at the time of hot rolling, so is preferably made 0.05% or less.

Next, the microstructure of the steel plate in the present invention will be explained in detail.

To achieve both strength and low temperature toughness of the steel plate, it is necessary that the microstructure be a continuously cooled transformed structure and that the in-grain precipitate density of the Nb and/or Ti carbonitride precipitates be $10^{17}$ to $10^{18}/cm^3$. Here, the "continuously cooled transformed structure (Zw)" in the present invention means a microstructure including one or more of $\alpha^{\circ}$ B, $\alpha$B, $\alpha$q, $\gamma$r, and MA. The small amounts of $\gamma$r and MA are included in a total of 3% or less.

Next, the reasons for limitation in the method of production of the present invention will be explained in detail.

The method of production preceding the hot rolling process by a converter in the present invention is not particularly limited. That is, pig iron may be discharged from a blast furnace, then dephosphorized, desulfurized, and otherwise preliminarily treated then refined by a converter or scrap or other cold iron sources may be melted in an electric furnace etc., then adjusted in ingredients in various secondary refining processes so as to contain the targeted ingredients, then cast by the usual continuous casting, casting by the ingot method, or thin slab casting, or other methods. However, when the specification of a souring resistance is added, to reduce the center segregation in the slab, it is preferable to apply measures against segregation such as pre-solidification rolling in the continuous casting segment. Alternatively, reducing the cast thickness of the slab is effective.

In the case of a slab obtained by continuous casting or thin slab casting, the slab can be sent directly to the hot rolling mills in the high temperature slab state or can be cooled to room temperature, then reheated at a heating furnace, then hot rolled. However, in the case of hot charge rolling (HCR), to destroy the cast structure and to reduce the austenite particle size at the time of slab reheating by the $\gamma \rightarrow \alpha \rightarrow \gamma$ transformation, cooling to less than the $Ar_3$ transformation point temperature is preferable. More preferable is less than the $Ar_1$ transformation point temperature.

The slab reheating temperature (SRT) is made at least a temperature calculated by the following formula:

$$SRT(^{\circ}C.)=6670/(2.26-\log[\%Nb][\%C])-273$$

If less than this temperature, not only will the coarse carbonitrides of Nb formed at the time of slab production not sufficiently dissolve and the effect of refinement of the crystal grains due to the suppression of recovery and recrystallization of austenite and rough growth by Nb in the later rolling process and due to the delay in $\gamma/\alpha$ transformation not be obtained, but also the effect of formation of fine carbides in the characteristic coiling process of the hot coil production process and the improvement of the strength by precipitation strengthening is not obtained. However, with heating of less than 1100° C., the amount of scale removal becomes small and inclusions on the slab surface may no longer be able to be removed by subsequent descaling along with the scale, so the slab reheating temperature is preferably made 1100° C. or more.

On the other hand, if over 1230° C., the austenite becomes coarser in particle size, the effect of refinement of the effective crystal grain size in the subsequent controlled rolling cannot be obtained, and the microstructure will not become a continuously cooled transformed structure, so the effect of improvement of the low temperature toughness by the continuously cooled transformed structure is liable to no longer be enjoyed. The temperature is more preferably 1200° C. or less.

The slab heating time is 20 minutes or more from when reaching that temperature so as to enable sufficient dissolution of Nb carbonitrides.

The following hot rolling process is usually comprised of a rough rolling process comprised of several rolling mills including a reverse rolling mill and a final rolling process having six to seven rolling mills arranged in tandem. In general, the rough rolling process has the advantage of enabling the number of passes and amount of reduction at each pass to be freely set, but the time between passes is long and recovery and recrystallization are liable to proceed between passes.

On the other hand, the final rolling process is the tandem type, so the number of passes becomes the same as the number of rolling stands, but the time between passes is short and the effect of controlled rolling is easily obtained. Therefore, to realize superior low temperature toughness, design of the process making sufficient use of these characteristics of the rolling process in addition to the steel ingredients is necessary.

Further, for example, when the product thickness exceeds 20 mm, if the roll gap of the final rolling No. 1 stand is 55 mm or less due to restrictions in facilities, it is not possible to satisfy the condition of the requirement of the present invention of the total reduction rate of the pre-recrystallization temperature region being 65% or more by just the final rolling process, so it is also possible to perform the controlled rolling in the pre-recrystallization temperature region at a stage after the rough rolling process. In the above case, in accordance with need, it is waited until the temperature falls to the pre-recrystallization temperature region or a cooling system is used for cooling.

Furthermore, between the rough rolling and the final rolling, it is possible to join a sheet bar and continuously perform final rolling. At that time, it is possible to wind the bar assembly into a coil shape once, store it in a cover having a heat holding function in accordance with need, unwind it, then join it.

In the final rolling process, rolling is performed in the pre-recrystallization temperature region, but when the temperature at the point of time of the end of rough rolling does not reach the pre-recrystallization temperature region, it is possible to wait in time until the temperature falls to the pre-recrystallization temperature region in accordance with need or to cool by a cooling system between the rough/final rolling stands in accordance with need.

If the total reduction rate in the pre-recrystallization temperature region is less than 65%, the effect of refining the effective crystal grain size by controlled rolling cannot be obtained and the microstructure will not become a continuously cooled transformed structure, so the low temperature toughness will deteriorate. Therefore, the total reduction rate of the pre-recrystallization temperature region is made 65% or more. Furthermore, to obtain a superior low temperature toughness, the total reduction rate of the pre-recrystallization temperature region is preferably 70% or more.

The final rolling end temperature ends at the $Ar_3$ transformation point temperature or more. In particular, if less than the $Ar_3$ transformation point temperature at the center part of plate thickness, $\alpha+\gamma$ dual phase region rolling occurs, remarkable separation occurs at the ductile fracture surface, and the absorption energy remarkably falls, so the final rolling end temperature ends at the $Ar_3$ transformation point temperature or more at the center of plate thickness. Further, the plate surface temperature as well is preferably made the $Ar_3$ transformation point temperature or more.

Even if not particularly limiting the rolling pass schedule at each stand in the final rolling, the effect of the present invention can be obtained, but from the viewpoint of precision of the plate shape, the rolling rate at the final stand is preferably less than 10%.

Here, the "$Ar_3$ transformation point temperature" is shown simply for example by the relationship with the steel ingredients by the following calculation formula: That is, $$Ar_3(^{\circ}C.)=910-310\times\%C+25\times\%Si-80\times\%Mneq$$

where, $Mneq=Mn+Cr+Cu+Mo+Ni/2+10(Nb-0.02)$

Alternatively, $Mneq=Mn+Cr+Cu+Mo+Ni/2+10(Nb-0.02)+1$: B addition

The cooling is started within 5 seconds after the end of the final rolling. If more than 5 seconds time is taken until the start of cooling after the end of final rolling, the microstructure will come to include polygonal ferrite and the strength is liable to drop. Further, the cooling start temperature is not particularly limited, but if starting cooling from less than the $Ar_3$ transformation point temperature, the microstructure will come to include polygonal ferrite and the strength is liable to drop, so the cooling start temperature is preferably made the $Ar_3$ transformation point temperature or more.

The cooling rate in the temperature region from the start of cooling down to 700° C. is made 15° C./sec or more.

If the cooling rate is less than 15° C./sec, the plane intensity ratio becomes less than 1.1, separation occurs at the fracture surface, and the absorption energy falls. Therefore, to obtain superior low temperature toughness, the cooling rate is made 15° C./sec or more to obtain the requirement of the present invention of a plane intensity ratio $\{211\}/\{111\} \geq 1.1$. Furthermore, if 20° C./sec or more, it becomes possible to improve the strength without changing the steel ingredients and degrading the low temperature toughness, so the cooling rate is preferably made 20° C./sec or more. The effect of the present invention would seem to be able to be obtained even without particularly setting an upper limit of the cooling rate, but even if a cooling rate of over 50° C./sec is achieved, not only is the effect saturated, but also plate warping due to thermal strain is feared, so the rate is preferably made not more than 50° C./sec.

The cooling rate in the temperature region from 700° C. up to coiling does not particularly have to be limited in relation to the effect of the present invention of suppressing the occurrence of separation, so air-cooling or a cooling rate commensurate with the same is also possible. However, to suppress the formation of coarse carbides and, furthermore, obtain a superior strength-toughness balance, the average cooling rate from the end of rolling to coiling is preferably 15° C./sec or more.

After cooling, the characteristic coiling process of the hot coil production process is effectively utilized. The cooling stop temperature and the coiling temperature are made the 450° C. to 650° C. temperature region. If stopping the cooling at 650° C. or more and then coiling, a phase is formed including pearlite and other coarse carbides not desirable for low temperature toughness and the requirement of the present invention of a microstructure of a continuously cooled transformed structure cannot be obtained. Not only this, Nb and other coarse carbonitrides are formed and become starting points of fracture and the low temperature toughness and souring resistance are liable to be degraded. On the other hand, if less than 450° C., if ending the cooling and coiling, the Nb and other fine carbide precipitates extremely effective for obtaining the targeted strength cannot be obtained and the requirement of the in-grain precipitate density of the Nb and/or Ti carbonitride precipitates of $10^{17}$ to $10^{18}/cm^3$ targeted by the present invention is not satisfied. Further, as a result, sufficient precipitation strengthening cannot be obtained and the targeted strength can no longer be obtained. Therefore, the cooling is stopped and the coiling temperature region is made 450° C. to 650° C.

Examples

Below, examples will be used to further explain the present invention.

The steels of A to J having the chemical ingredients shown in Table 2 are produced in a converter, continuously cast, then directly sent on or reheated, rough rolled, then final rolled to reduce them to a 20.4 mm plate thickness, cooled on a runout table, then coiled. Note that the chemical compositions in the table are indicated by mass %.

The details of the production conditions are shown in Table 3. Here, the "ingredients" shows the codes of the slabs shown in Table 2, the "heating temperature" shows the actual slab heating temperatures, the "solution temperature" shows the temperature calculated by the following formula:

$$SRT(°C.)=6670/(2.26-\log[\%Nb][\%C])-273,$$

the "holding time" shows the holding time at the actual slab heating temperature, the "cooling between passes" shows the existence of any cooling between rolling stands aimed at shortening the temperature waiting time arising before rolling in the pre-recrystallization temperature region, the "pre-recrystallization region total reduction rate" shows the total reduction rate of the rolling performed in the pre-recrystallization temperature region, "FT" shows the final rolling end temperature, "$Ar_3$ transformation point temperature" shows the calculated $Ar_3$ transformation point temperature, "time until start of cooling" shows the time from the end of the final rolling to the start of the cooling, "cooling rate up to 700° C." shows the average cooling rate at the time of passing through the temperature region from the cooling start temperature to 700° C., and "CT" shows the coiling temperature.

The properties of the thus obtained steel plates are shown in Table 4. The methods of evaluation are the same as the above-mentioned methods. Here, "microstructure" shows the microstructure at ½t of the steel plate thickness, "plane intensity ratio" shows the ratio {211}/{111} of reflected X-ray intensity of the {211} plane and {111} plane parallel to the plate surface in the texture at the center of plate thickness, "precipitate density" shows the precipitate density of Nb and/or Ti carbonitride precipitates precipitating in the microstructure not at the grain boundaries, the results of the "tensile test" show the results of a C-direction JIS No. 5 test piece, in the results of the "DWTT test", "SATT (85%)" shows the test temperature where the ductile fracture rate becomes 85% in the DWTT test, "upper shelf energy" shows the upper shelf energy obtained by a transition curve in the DWTT test, and "S.I." shows the separation index in a test piece with a ductile fracture rate of 85%.

The steels in accordance with the present invention are the 12 steels of Steel Nos. 1, 2, 3, 11, 12, 13, 14, 15, 16, 18, 24, and 25, 27, and 28. They are characterized in that they contain predetermined amounts of steel ingredients, have microstructures of continuously cooled transformed structures, and have plane intensity ratios parallel to the plate surface in the texture at the center of plate thickness of 1.1 or more and they give high strength hot rolled steel plate for line-pipes superior in low temperature toughness having a tensile strength equivalent to the X70 grade as materials before being made into pipes.

The other steels are outside the scope of the present invention for the following reasons. That is, Steel No. 4 has a heating temperature outside the scope of claim 3 of the present invention, so the targeted in-grain precipitation density of the precipitate described in claim 1 is not obtained, and sufficient tensile strength is not obtained. Steel No. 5 has a heating holding time outside the scope of claim 3 of the present invention, so the in-grain precipitate density of the targeted precipitate described in claim 1 is not obtained, and sufficient tensile strength is not obtained. Steel No. 6 has a total reduction rate of the pre-recrystallization temperature region outside the scope of claim 3 of the present invention, so the targeted microstructure described in claim 1 is not obtained, and sufficient low temperature toughness is not obtained. Steel No. 7 has a heating temperature outside the scope of claim 3 of the present invention, so the targeted microstructure described in claim 1 is not obtained, and sufficient low temperature toughness is not obtained. Steel No. 8 has a time until the start of cooling outside the scope of claim 3 of the present invention, so the targeted microstructure described in claim 1 is not obtained, and sufficient low temperature toughness is not obtained. Steel No. 9 has a cooling rate outside the scope of claim 3 of the present invention, so the targeted plane intensity ratio described in claim 1 is not obtained, and sufficient low temperature toughness is not obtained. Steel No. 10 has a CT outside the scope of claim 3 of the present invention, so the targeted microstructure and in-grain precipitate density of the precipitate described in claim 1 are not obtained, and sufficient tensile strength and low temperature toughness are not obtained. Steel No. 17 has an FT outside the scope of claim 3 of the present invention, so the targeted plane intensity ratio and microstructure described in claim 1 are not obtained, and sufficient low temperature toughness is not obtained. Steel No. 19 has steel ingredients outside the scope of claim 1 of the present invention, so the targeted microstructure is not obtained, and sufficient low temperature toughness is not obtained. Steel No. 20 has steel ingredients outside the scope of claim 1 of the present invention, so the targeted microstructure is not obtained, and sufficient low temperature toughness is not obtained. Steel No. 21 has steel ingredients outside the scope of claim 1 of the present invention, so sufficient tensile strength and low temperature toughness are not obtained. Steel No. 22 has steel ingredients outside the scope of claim 1 of the present invention, so sufficient tensile strength and low temperature toughness are not obtained. Steel No. 23 has steel ingredients outside the scope of claim 1 of the present invention, so sufficient low temperature toughness is not obtained. Steel No. 26 has a cooling rate outside the scope of claim 3 of the present invention, so the targeted plane intensity ratio described in claim 1 is not obtained, and sufficient low temperature toughness is not obtained.

TABLE 1

| (mass %) | | | | | | | | | | | | | | | | |
|---|---|---|---|---|---|---|---|---|---|---|---|---|---|---|---|---|
| C | Si | Mn | P | S | O | Al | N | Nb | Ti | V | Mo | Cr | Cu | Ni | N − 14/48 * Ti | Nb-93/14 * (N − 14/48 * Ti) |
| 0.063 | 0.23 | 1.61 | 0.012 | 0.004 | | 0.037 | 0.0038 | 0.046 | 0.012 | 0.031 | 0.072 | 0.15 | 0.15 | 0.15 | 0.0003 | 0.044007 |

TABLE 2

| | Chemical composition (unit: mass %) | | | | | | | | | | | | |
|---|---|---|---|---|---|---|---|---|---|---|---|---|---|
| steel | C | Si | Mn | P | S | O | Al | N | Nb | Ti | N* | Nb − 93/14 × N* | Others |
| A | 0.064 | 0.24 | 1.59 | 0.009 | 0.003 | 0.0021 | 0.029 | 0.0040 | 0.058 | 0.011 | 0.0008 | 0.0527 | Mo: 0.078%, V: 0.033%, Cr: 0.14%, Cu: 0.15%, Ni: 0.12% |
| B | 0.058 | 0.22 | 1.52 | 0.008 | 0.001 | 0.0029 | 0.045 | 0.0033 | 0.047 | 0.010 | 0.0004 | 0.0445 | Mo: 0.178%, V: 0.053%, Cu: 0.12%, Ni: 0.11% |
| C | 0.074 | 0.20 | 1.58 | 0.011 | 0.002 | 0.0022 | 0.027 | 0.0041 | 0.050 | 0.012 | 0.0006 | 0.0460 | Cr: 0.17%, Cu: 0.22%, Ni: 0.18% |
| D | 0.056 | 0.24 | 1.60 | 0.013 | 0.003 | 0.0020 | 0.027 | 0.0039 | 0.060 | 0.009 | 0.0013 | 0.0515 | Mo: 0.075%, V: 0.061%, Ca: 0.0020% |
| E | 0.067 | 0.23 | 1.61 | 0.007 | 0.001 | 0.0020 | 0.025 | 0.0033 | 0.049 | 0.010 | 0.0004 | 0.0465 | Mo: 0.170%, V: 0.030% |
| F | 0.066 | 0.22 | 1.54 | 0.010 | 0.001 | 0.0028 | 0.043 | 0.0040 | 0.048 | 0.020 | −0.0018 | 0.0602 | Mo: 0.106%, V: 0.031%, Cr: 0.11%, Cu: 0.11%, Ni: 0.13% |
| G | 0.055 | 0.24 | 1.55 | 0.011 | 0.003 | 0.0025 | 0.022 | 0.0009 | 0.060 | 0.011 | −0.0023 | 0.0753 | Mo: 0.075%, V: 0.031% |
| H | 0.056 | 0.23 | 1.62 | 0.013 | 0.001 | 0.0023 | 0.024 | 0.0038 | 0.002 | 0.001 | 0.0035 | −0.0213 | Mo: 0.071%, V: 0.060% |
| I | 0.108 | 0.45 | 1.89 | 0.010 | 0.001 | 0.0021 | 0.025 | 0.0038 | 0.001 | 0.001 | 0.0035 | −0.0223 | |
| J | 0.060 | 0.20 | 1.54 | 0.011 | 0.001 | 0.0139 | 0.044 | 0.0035 | 0.045 | 0.011 | 0.0003 | 0.0431 | Mo: 0.181%, V: 0.050%, Cu: 0.10%, Ni: 0.15% |
| K | 0.072 | 0.26 | 1.59 | 0.007 | 0.001 | 0.0030 | 0.022 | 0.0040 | 0.075 | 0.012 | 0.0005 | 0.0717 | B: 0.0008% |
| L | 0.076 | 0.20 | 1.67 | 0.010 | 0.002 | 0.0028 | 0.025 | 0.0041 | 0.077 | 0.011 | 0.0009 | 0.0711 | |

*N*: N − 14/48 × Ti

TABLE 3

| | Production conditions | | | | | | | | | | |
|---|---|---|---|---|---|---|---|---|---|---|---|
| Steel No. | Ingredients | Heating temp. (° C.) | Solution temp. (° C.) | Holding time (min) | Cooling between passes | Pre-recrystallization region total reduction rate (%) | FT (° C.) | $Ar_3$ transformation point temp. (° C./sec) | Time until cooling start (sec) | Cooling rate until 700° C. (° C./sec) | CT (° C.) |
| 1 | A | 1180 | 1149 | 30 | No | 75 | 800 | 704 | 4.1 | 16 | 585 |
| 2 | A | 1180 | 1149 | 30 | No | 75 | 800 | 704 | 4.1 | 16 | 585 |
| 3 | A | 1180 | 1149 | 30 | Yes | 75 | 800 | 704 | 4.1 | 16 | 585 |
| 4 | A | 1100 | 1149 | 30 | No | 75 | 800 | 704 | 4.1 | 16 | 585 |
| 5 | A | 1180 | 1149 | 5 | No | 75 | 800 | 704 | 4.1 | 16 | 585 |
| 6 | A | 1180 | 1149 | 30 | No | 62 | 800 | 704 | 4.1 | 16 | 585 |
| 7 | A | 1260 | 1149 | 30 | No | 75 | 800 | 704 | 4.1 | 16 | 585 |
| 8 | A | 1180 | 1149 | 30 | No | 75 | 800 | 704 | 6.6 | 16 | 585 |
| 9 | A | 1180 | 1149 | 30 | No | 75 | 800 | 704 | 4.1 | 9 | 585 |
| 10 | A | 1180 | 1149 | 30 | No | 75 | 800 | 704 | 4.1 | 16 | 675 |
| 11 | B | 1150 | 1110 | 30 | No | 75 | 810 | 726 | 4.3 | 18 | 540 |
| 12 | C | 1180 | 1149 | 30 | No | 80 | 790 | 703 | 3.3 | 25 | 500 |
| 13 | D | 1200 | 1136 | 30 | Yes | 75 | 820 | 733 | 3.8 | 22 | 600 |

TABLE 3-continued

| Steel No. | Ingredients | Production conditions: Heating temp. (° C.) | Solution temp. (° C.) | Holding time (min) | Cooling between passes | Pre-recrystallization region total reduction rate (%) | FT (° C.) | $Ar_3$ transformation point temp. (° C./sec) | Time until cooling start (sec) | Cooling rate until 700° C. (° C./sec) | CT (° C.) |
|---|---|---|---|---|---|---|---|---|---|---|---|
| 14 | D | 1200 | 1136 | 30 | Yes | 66 | 820 | 733 | 3.8 | 22 | 600 |
| 15 | D | 1150 | 1136 | 60 | Yes | 75 | 820 | 733 | 3.8 | 22 | 600 |
| 16 | D | 1200 | 1136 | 30 | No | 75 | 820 | 733 | 3.8 | 22 | 620 |
| 17 | D | 1200 | 1136 | 30 | Yes | 75 | 700 | 733 | 3.8 | 22 | 600 |
| 18 | E | 1150 | 1133 | 30 | Yes | 75 | 810 | 729 | 4.3 | 18 | 540 |
| 19 | F | 1180 | 1128 | 30 | No | 75 | 780 | 718 | 4.3 | 18 | 580 |
| 20 | G | 1180 | 1134 | 30 | No | 75 | 780 | 737 | 4.1 | 16 | 570 |
| 21 | H | 1180 | 801 | 30 | No | 75 | 820 | 778 | 3.8 | 16 | 550 |
| 22 | I | 1180 | 798 | 30 | No | 62 | 840 | 752 | 3.8 | 8 | 600 |
| 23 | J | 1180 | 1108 | 30 | No | 75 | 800 | 725 | 4.1 | 16 | 580 |
| 24 | K | 1220 | 1200 | 45 | No | 75 | 765 | 615 | 3.3 | 18 | 585 |
| 25 | L | 1220 | 1212 | 45 | No | 75 | 765 | 684 | 3.3 | 18 | 585 |
| 26 | B | 1150 | 1110 | 30 | No | 75 | 810 | 726 | 4.3 | 5 | 540 |

TABLE 4

| Steel No. | Microstructure: Micro-structure | Plane intensity ratio | Precipitate density (/cm³) | Mechanical properties: Tensile test: YP (MPa) | TS (MPa) | El (%) | DWTT test: SATT (85%) (° C.) | Upper shelf energy (J) | S.I. | Remarks |
|---|---|---|---|---|---|---|---|---|---|---|
| 1 | Zw | 1.15 | $5 \times 10^{17}$ | 530 | 645 | 40 | −30 | 12000 | 0.03 | Invention |
| 2 | Zw | 1.21 | $5 \times 10^{17}$ | 535 | 650 | 39 | −20 | 10000 | 0.02 | Invention |
| 3 | Zw | 1.16 | $5 \times 10^{17}$ | 520 | 640 | 41 | −35 | 12000 | 0.03 | Invention |
| 4 | Zw | 1.11 | $5 \times 10^{16}$ | 484 | 590 | 43 | −35 | 12500 | 0.03 | Comp. ex. |
| 5 | Zw | 1.13 | $1 \times 10^{16}$ | 499 | 607 | 42 | −35 | 12500 | 0.03 | Comp. ex. |
| 6 | B | 1.22 | $4 \times 10^{17}$ | 533 | 648 | 39 | −10 | 12000 | 0.02 | Comp. ex. |
| 7 | B | 1.12 | $7 \times 10^{17}$ | 541 | 654 | 38 | −10 | 11000 | 0.03 | Comp. ex. |
| 8 | PF + P | 1.12 | $1 \times 10^{17}$ | 531 | 644 | 38 | −5 | 9000 | 0.06 | Comp. ex. |
| 9 | Zw | 0.75 | $1 \times 10^{17}$ | 520 | 638 | 39 | −20 | 8500 | 0.12 | Comp. ex. |
| 10 | PF + P | 1.11 | $1 \times 10^{16}$ | 452 | 552 | 45 | −30 | 9500 | 0.01 | Comp. ex. |
| 11 | Zw | 1.18 | $1 \times 10^{17}$ | 520 | 636 | 40 | −20 | 10000 | 0.02 | Invention |
| 12 | Zw | 1.33 | $1 \times 10^{17}$ | 506 | 628 | 42 | −25 | 10000 | 0.01 | Invention |
| 13 | Zw | 1.32 | $3 \times 10^{17}$ | 535 | 649 | 39 | −25 | 11000 | 0.01 | Invention |
| 14 | Zw | 1.30 | $2 \times 10^{17}$ | 544 | 652 | 38 | −20 | 11000 | 0.01 | Invention |
| 15 | Zw | 1.29 | $1 \times 10^{17}$ | 526 | 633 | 40 | −30 | 10000 | 0.01 | Invention |
| 16 | Zw | 1.31 | $6 \times 10^{17}$ | 540 | 644 | 38 | −20 | 10500 | 0.01 | Invention |
| 17 | PF + Zw | 0.56 | $1 \times 10^{17}$ | 577 | 636 | 30 | −15 | 8800 | 0.17 | Comp. ex. |
| 18 | Zw | 1.20 | $1 \times 10^{17}$ | 515 | 629 | 41 | −20 | 10000 | 0.02 | Invention |
| 19 | B | 1.18 | $2 \times 10^{17}$ | 526 | 633 | 40 | −10 | 10000 | 0.02 | Comp. ex. |
| 20 | B | 1.14 | $1 \times 10^{17}$ | 513 | 622 | 41 | −10 | 9500 | 0.03 | Comp. ex. |
| 21 | PF + P | 1.11 | Not observable | 347 | 466 | 46 | −40 | 12500 | 0.03 | Comp. ex. |
| 22 | PF + P | 0.88 | Not observable | 388 | 545 | 42 | −5 | 9000 | 0.11 | Comp. ex. |
| 23 | Zw | 1.15 | $5 \times 10^{17}$ | 530 | 641 | 38 | −5 | 8600 | 0.01 | Comp. ex. |
| 24 | Zw | 1.14 | $8 \times 10^{17}$ | 522 | 646 | 37 | −25 | 10500 | 0.01 | Invention |
| 25 | Zw | 1.12 | $8 \times 10^{17}$ | 510 | 630 | 38 | −20 | 10000 | 0.01 | Invention |
| 26 | Zw | 0.70 | $1 \times 10^{17}$ | 500 | 621 | 40 | −20 | 9000 | 0.15 | Comp. ex. |

PF: polygonal ferrite,
P: pearlite,
B: bainite

INDUSTRIAL APPLICABILITY

By using the hot rolled steel plate of the present invention for hot coil for seam welded steel pipe and spiral steel pipe, not only does it become possible to produce API-X70 standard or higher strength line-pipes of a thick gauge, for example, a thickness of 14 mm or more, for use in a frigid region where high low temperature toughness is demanded, but also the method of production of the present invention enables production of hot coil for seam welded steel pipe and spiral steel pipe inexpensively in large quantities, so the present invention can be said to be an invention with high industrial value.

The invention claimed is:

1. High strength hot rolled steel product for line-pipes, comprising, by mass %, C: 0.01 to 0.1%, Si: 0.05 to 0.5%, Mn: 1 to 2%,

P: ≤0.03%,

S: ≤0.005%,

O: ≤0.003%,
Al: 0.005 to 0.05%,
N: 0.0015 to 0.006%,
Nb: 0.005 to 0.08%, and
Ti: 0.005 to 0.02%, where
N−14/48×Ti>0% and
Nb−93/14×(N−14/48×Ti)>0.005%, and
a balance of Fe and unavoidable impurities, wherein
the steel product is in the form of a steel plate having a continuously cooled transformed structure microstructure and a thickness of 14 mm or more,
a reflected X-ray intensity ratio, {211}/{111}, of the {211} plane and {111} plane parallel to the plate surface in the texture at the center of plate thickness of 1.1 or more, and
an in-grain precipitate density of the precipitates of Nb and/or Ti carbonitrides of $10^{17}$ to $10^{18}/cm^3$.

2. The high strength hot rolled steel product for line-pipes as set forth in claim 1, further comprising one or more of:
V: 0.01 to 0.3%,
Mo: 0.01 to 0.3%,
Cr: 0.01 to 0.3%,
Cu: 0.01 to 0.3%,
Ni: 0.01 to 0.3%,
B: 0.0002 to 0.003%,
Ca: 0.0005 to 0.005%, and
REM: 0.0005 to 0.02%.

3. A method of production of high strength hot rolled steel products for line-pipes, comprising heating a steel slab comprising, by mass %,
C: 0.01 to 0.1%,
Si: 0.05 to 0.5%,
Mn: 1 to 2%,
P: ≤0.03%,
S: ≤0.005%,
O: ≤0.003%,
Al: 0.005 to 0.05%,
N: 0.0015 to 0.006%,
Nb: 0.005 to 0.08%, and
Ti: 0.005 to 0.02%, where
N−14/48×Ti>0% and
Nb−93/14×(N−14/48×Ti)>0.005%, and
a balance of Fe and unavoidable impurities to a temperature in the range of a temperature satisfying the formula:

$$SRT(°C.)=6670/(2.26-\log[\%Nb][\%C])-273$$

to a temperature of 1230° C.,
holding the heated steel slab in that temperature region for 20 minutes or more,
then hot rolling the heated steel slab in a pre-recrystallization temperature region at a total reduction rate of 65% or more,
ending that rolling at an $Ar_3$ transformation point temperature or more,
then starting cooling within 5 seconds,
cooling in the temperature region ranging from the temperature at the start of cooling to 700° C. at a cooling rate of 15° to 50° C./second, and
coiling at 450° C. to 650° C.,
wherein an in-grain precipitate density of the precipitates of Nb and/or Ti carbonitrides of the hot rolled steel products is $10^{17}$ to $10^{18}/cm^3$.

4. The method as set forth in claim 3, further comprising cooling before rolling in the pre-recrystallization temperature region.

5. The method as set forth in claim 3, wherein the steel slab further comprises one or more of:
V: 0.01 to 0.3%,
Mo: 0.01 to 0.3%,
Cr: 0.01 to 0.3%,
Cu: 0.01 to 0.3%,
Ni: 0.01 to 0.3%,
B: 0.0002 to 0.003%,
Ca: 0.0005 to 0.005%, and
REM: 0.0005 to 0.02%.

6. The method as set forth in claim 5, further comprising cooling before rolling in the pre-recrystallization temperature region.

7. The method as set forth in claim 3, wherein the cooling rate for cooling in the temperature region ranging from the temperature at the start of cooling to 700° C. is 16° C./second to 25° C./second.

* * * * *

UNITED STATES PATENT AND TRADEMARK OFFICE

CERTIFICATE OF CORRECTION

PATENT NO. : 8,562,762 B2
APPLICATION NO. : 12/449815
DATED : October 22, 2013
INVENTOR(S) : Tatsuo Yokoi et al.

It is certified that error appears in the above-identified patent and that said Letters Patent is hereby corrected as shown below:

In the Specification

Column 2, line 2, change “thicker in walls:” to -- thicker in walls. --;

Column 14, line 37, change “and 25, 27 and 28.” to -- and 25. --.

Signed and Sealed this
Fifth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,562,762 B2
APPLICATION NO. : 12/449815
DATED : October 22, 2013
INVENTOR(S) : Yokoi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 247 days.

Signed and Sealed this
Fifteenth Day of September, 2015

Michelle K. Lee

Michelle K. Lee
*Director of the United States Patent and Trademark Office*